US005643063A

United States Patent [19]

Uzumcu et al.

[11] Patent Number: 5,643,063

[45] Date of Patent: Jul. 1, 1997

[54] CLAMPING MECHANISM FOR A POWERED SANDER

[76] Inventors: Albert I. Uzumcu, 1500 Brookside Dr., Hoffman Estates, Ill. 60194; Raymond R. Esparza, 5700 W. Gunnison, Chicago, Ill. 60630; Matthew H. Malone, 8610 W. Grand Ave., River Grove, Ill. 60171; Jose Nieto, 2812 S. Homan Ave., Chicago, Ill. 60623

[21] Appl. No.: 693,805

[22] Filed: Aug. 1, 1996

[51] Int. Cl.[6] ..... B24B 23/00; B24B 27/08

[52] U.S. Cl. ..... 451/356; 451/502; 451/236; 451/492; 451/524; 451/207

[58] Field of Search ..... 451/356, 502, 451/517, 522, 515, 521, 525, 164, 168

[56] References Cited

U.S. PATENT DOCUMENTS

| | | | |
|---|---|---|---|
| 2,515,469 | 7/1950 | Power | 407/29.15 |
| 2,922,177 | 1/1960 | Hudson | 401/207 |
| 3,034,267 | 5/1962 | Feeney | 451/492 |
| 3,842,549 | 10/1974 | Johnston | 451/524 |
| 3,914,906 | 10/1975 | Barnes . | |
| 5,131,193 | 7/1992 | Demers | 451/524 |
| 5,337,523 | 8/1994 | Walsh | 451/502 |
| 5,470,272 | 11/1995 | Kikuchi et al. | 451/236 |

FOREIGN PATENT DOCUMENTS

| | | |
|---|---|---|
| 2122082 | 10/1994 | Canada . |
| 8529793 | 10/1985 | Germany . |
| 241056 | 2/1946 | Switzerland . |

*Primary Examiner*—Robert A. Rose
*Assistant Examiner*—George Nguyen
*Attorney, Agent, or Firm*—Jones, Day, Reavis & Pogue

[57] ABSTRACT

A carrier is connected to the plunger for reciprocating therewith; the carrier is of inverted U-shape defining a recess open at its bottom. A holder is pivotally mounted to the carrier for swinging movement back and forth between a first position wherein the holder is substantially nested within the recess in the carrier and a second position wherein a substantial portion of the holder extends out of and away from the carrier recess. The holder is also of inverted U-shape defining a cavity for receiving a portion of a contour sanding member. Detent elements on the carrier compress the holder when the latter is in its first position thereby to impart a clamping force to a contour sanding member received within the cavity of the holder. A manually operated ejection member mounted on the tool housing engages the holder for moving the same from its first position to its second position.

5 Claims, 4 Drawing Sheets

CLAMPING MECHANISM FOR A POWERED SANDER

The present invention relates to powered sanders. More particularly, the present invention relates to a clamping mechanism for clamping contour members to the reciprocating plunger of a powered sander.

BACKGROUND OF THE INVENTION

Many varieties of orbital and belt sanders are well known to those skilled in the sanding art. These sanders have moving planar surfaces and perform very efficiently when sanding flat surfaces. However, these sanders are of limited utility when it is desired to sand curved surfaces or other surfaces that are inaccessible to a flat abrasive member. Concave and convex surfaces, grooves, score lines, beads and shutter slats are examples of objects which cannot be properly sanded using orbital or belt sanders.

It is known in the prior art to provide so-called profile sanders for sanding surfaces which are inaccessible to orbital and belt sanders. These prior art devices are both powered and manually operated.

An example of a powered profile sander is the Model 444 sander manufactured by Porter-Cable Corporation. The Model 444 profile sander includes a mounting plate which is detachably secured to the reciprocating member of the sander. A plurality of profile members, each having a portion configured to correspond to the contour of the surface to be sanded, are detachably secured one-at-a-time to the mounting plate. This tool is disadvantageous in that a separate mounting plate is necessary to attach a profile member to the tool.

An example of a manually operated profile sanding device is represented by the TADPOLE II sanding grips manufactured by Perfect Panel Products of Auburn, Wash. These sanding grips are not adapted for powered operation.

The Clamping mechanism of the present invention is particularly adapted for use with a sanding apparatus disclosed in application, Attorney Docket No. 960503, Ser. No. 08/675,244, filed Jul. 8, 1996, and assigned to the assignee of the present invention. That application discloses a sanding apparatus having a flexible tubular member with an outer abrasive surface and a plurality of contour members. Each contour member has a cross-section defined by a first portion and a second portion. The first portion of each contour member has the same cross-sectional shape as the first portions of the other contour members; the second portion of each contour member has a cross-sectional shape which is different from the cross-sectional shape of the second portions of the other contour members. Each second portion includes a contour section configured to conform substantially to the shape of the work-piece to be sanded. Each contour member is adapted to be received one-at-a-time within the tubular member and is dimensioned such that the tubular member will be in a taut condition when the tubular member has one of the contour members received therein and (1) is clamped to the first portion of the contour member and (2) has the abrasive area thereof adjacent the contour section of the contour member brought into engagement with the work-piece to be sanded.

SUMMARY AND OBJECTS OF THE PRESENT INVENTION

The present invention provides a new and improved clamping mechanism for clamping contour sanding members one-at-a-time to the reciprocating plunger of a powered sander.

A primary object of the present invention is the provision of a new and improved clamping mechanism permitting ready and convenient clamping and unclamping of the contour members from the reciprocating plunger of the powered sander.

Another object of the present invention is the provision of such a clamping mechanism which is effective in operation but is nevertheless simple in construction and susceptible of inexpensive manufacture.

Yet another object of the present invention is the provision of a clamping mechanism of the type described which includes ejection means for conveniently unclamping a contour sanding member from the reciprocating plunger of the powered sander.

These and other objects and advantages of the invention will become apparent from the following specification disclosing a preferred embodiment.

DESCRIPTION OF A PREFERRED EMBODIMENT

Figure 1:
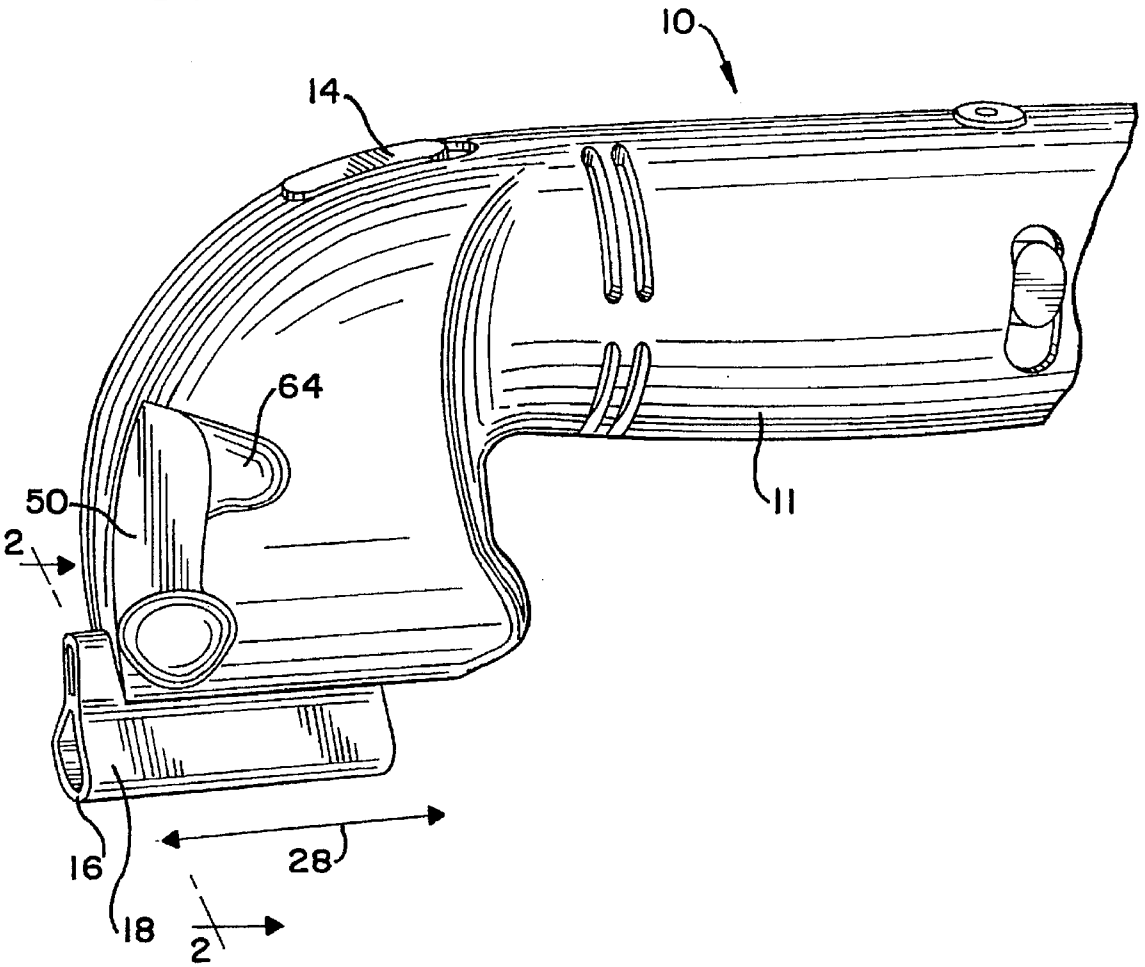
FIG. 1 is a perspective view of a powered sander embodying the clamping mechanism of the present invention.
Figure 5:
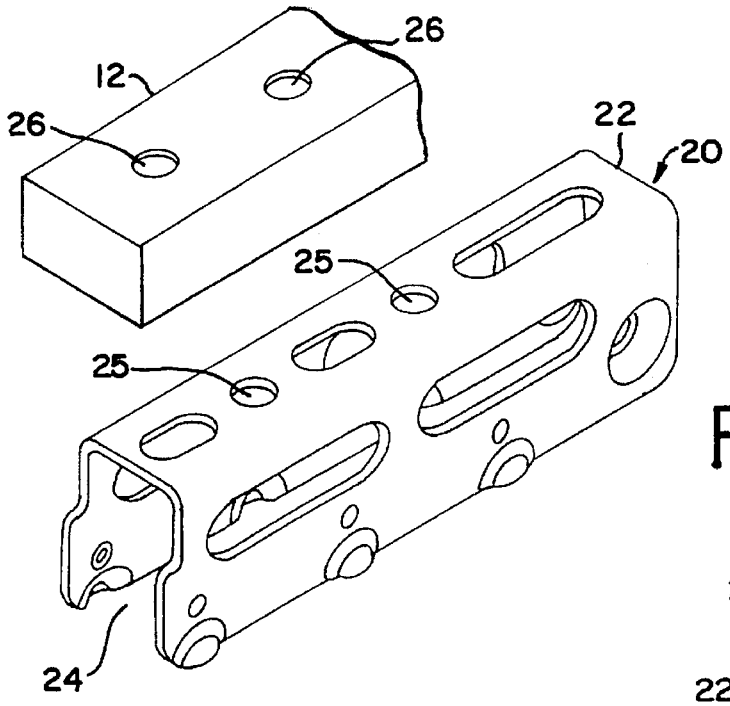
FIG. 5 is an isometric view of the carrier forming part of the clamping mechanism.

Referring to FIG. 1, a powered contour sander, generally designated 10, includes a housing 11. It will be understood that the housing 11 contains an electric motor and a suitable drive mechanism for reciprocating a plunger 12 (FIG. 5). The housing mounts a slide switch actuator 14 for energizing and deenergizing the electric motor.

The powered sander 10 is shown in FIG. 1 in clamping engagement with a contour member 16 received within a flexible tubular member 18 having an outer abrasive surface. The contour member and tubular member are preferably of the type disclosed and claimed in Application, Attorney Docket No. 960503, Ser. No. 08/675,244, filed Jul. 8, 1996, as referred to above.

It will be understood that a plurality of the contour member 16 are provided. Each contour member has a cross-section defined by a first portion 16*a* (FIG. 15) and a second portion 16*b*. The first portion 16*a* of each contour member has the same cross-sectional shape as the first portions of the other contour members (not shown). The second portion 16*b* of each contour member has a cross-sectional shape which is different from the cross-sectional shape of the second portions of the other contour members and includes a contour section 16*c* configured to conform substantially to the shape of the work-piece to be sanded. Each contour member is adapted to be received one-at-a-time within the tubular member 18 and is dimensioned such that the tubular member 18 will be in a taut condition when the tubular member has one of the contour members received therein and (1) is clamped to the first portion of the contour member and (2) has the abrasive area thereof adjacent the contour section 16*c* of the contour member brought into engagement with the work-piece to be sanded.

Referring now particularly to FIGS. 5–9, the clamping mechanism of the present invention includes a carrier, generally designated 20. It is seen that the carrier is in the form of an inverted U-shaped bar 22 with a bight portion 22*a* and parallel side walls 22*b* and 22*c* defining a recess 24. The carrier 20 includes a pair of openings 25 for receiving fasteners (not shown) which are also received in openings 26 formed in the reciprocating plunger 12. Thus, the carrier 20 is bolted to the plunger 12 for reciprocation therewith along an axis 28 (FIG. 1). The carrier 20 includes a number of openings 27, 28 which perform no functional purpose and are provided for weight and material saving purposes.

As seen in FIGS. 10–14, the clamping mechanism also includes a holder, generally designated 30. The holder is in the form of an inverted U-shaped bar 31 including a bight portion 31*a* and side walls 3l*b* and 31*c* thereby defining a cavity 33. The side walls 3l*b*, 31*c* include respective pivot openings 34 and 35. The holder 30 includes openings 36, 37 for weight and material savings purposes.

Figure 3:
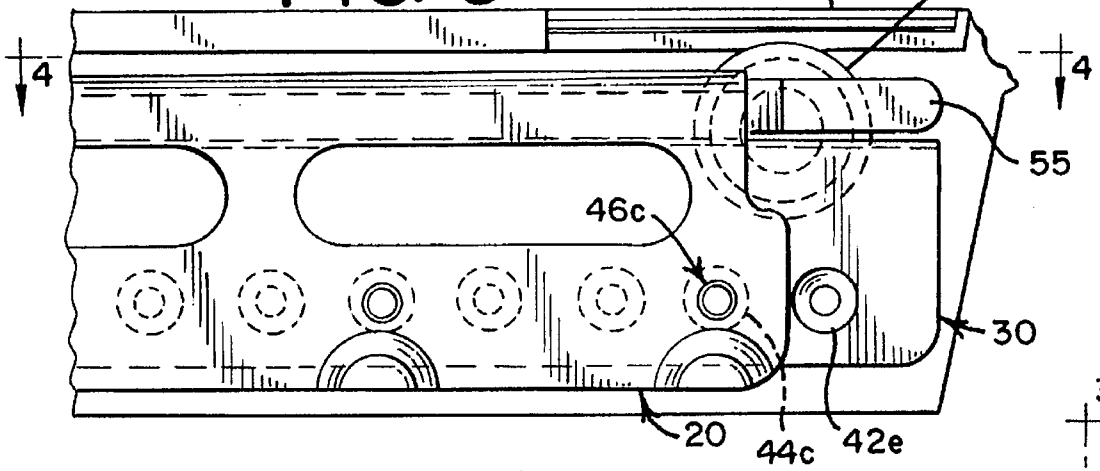
FIG. 3 is a side elevational view taken along the line 3—3 of FIG. 2.
Figure 7:
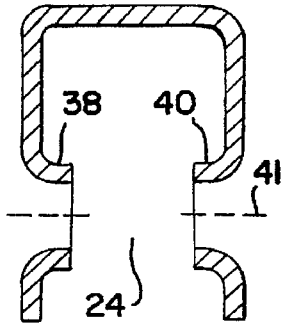
FIG. 7 is a section taken along the line 7—7 of FIG. 6.
Figure 6:
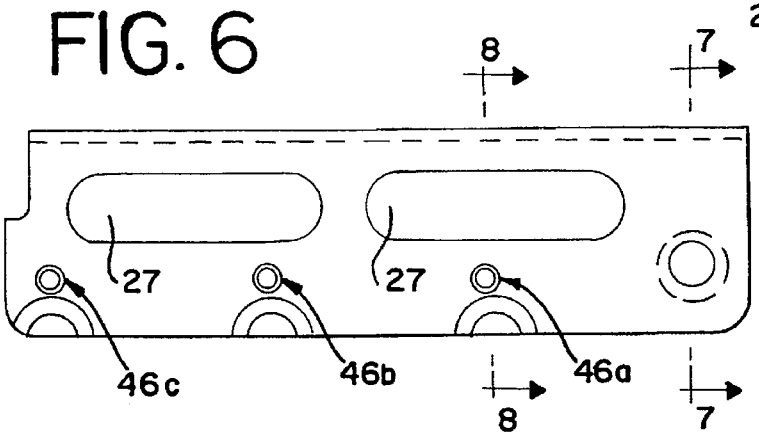
FIG. 6 is a side elevational view of the carrier.
Figure 9:
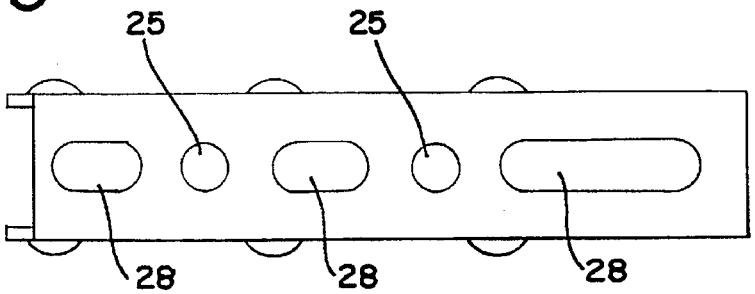
FIG. 9 is a top plan view of the carrier.
Figure 10:
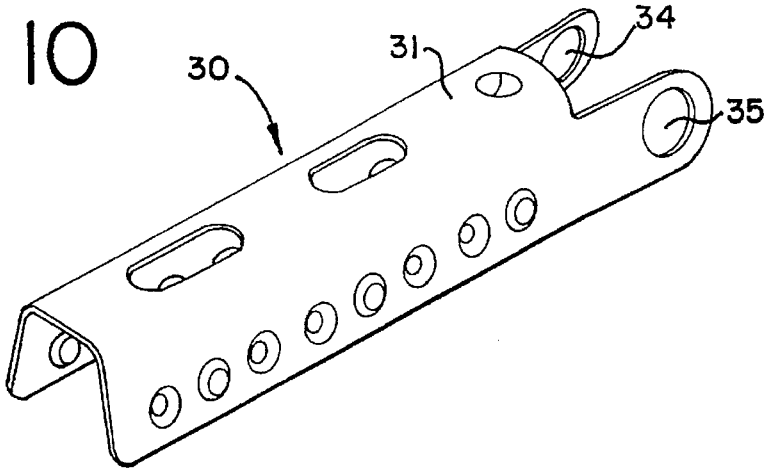
FIG. 10 is an isometric view of the holder forming part of the clamping mechanism.

Referring to FIGS. 6 and 7, it is seen that the carrier 20 includes boss formations 38 and 40 formed in its side walls 22*b* and 22*c*, respectively; the bosses 38 and 40 are adapted for respective engagement with the openings 34 and 35 in the holder 30 thereby to pivot the holder for swinging or pivoting movement with respect to the carrier 20 about an axis 41 (FIG. 7) which is perpendicular to the axis 28. The holder may be swung from a nested position as shown in FIG. 3 where the holder is substantially contained within the recess 24 of the carrier 20, to another position (not shown) wherein the holder 30 extends out of and away from the carrier 20. When it is desired to remove and replace the holder because of wear, the holder can be readily removed by squeezing the same near the openings 34, 35 thereby disengaging the holder from the boss formations on the carrier 20.

Figure 15:
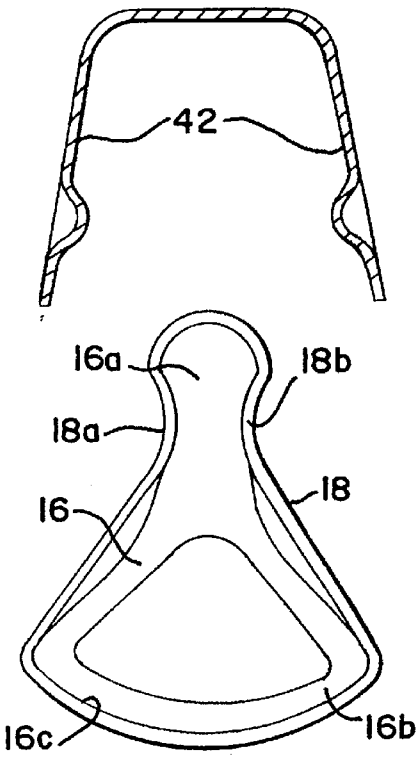
FIG. 15 is an end view of the holder shown in association with a contour member and a flexible tubular sanding member.
Figure 11:
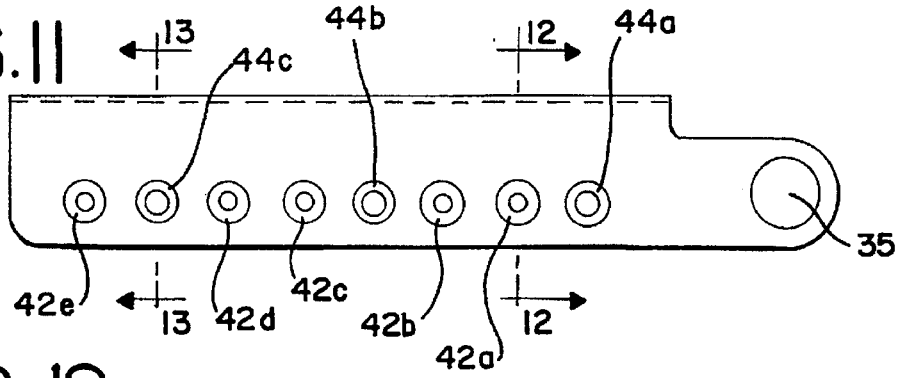
FIG. 11 is a side elevational view of the holder.
Figure 12:
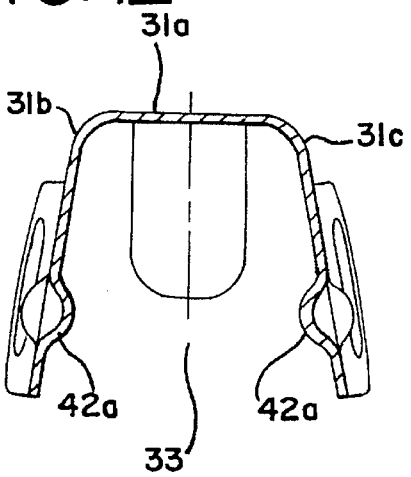
FIG. 12 is a section taken along the line 12—12 of FIG. 11.

Each side wall 3l*b*, 31*c* of the holder 30 is provided with a plurality of inwardly extending dimples 42*a*–42*e* (FIGS. 11 and 12). These dimples are adapted to be received within concave portions 18*a* and 18*b* of the tubular member 18 as seen in FIG. 15. These concave portions are formed by correspondingly shaped recesses in the portion 16*a* of the contour member 16. As noted in FIG. 12, the side walls 3l*b*, 31*c* diverge away from the bight portion 31*a* of the holder. When the holder is fully received within the carrier 20, which has parallel side walls 22*b*, 22*c*, the holder side walls will be brought into substantial parallel relationship with each other. Thus, the dimples 42*a*–42*e* provide a clamping or squeezing force for securely holding the contour member 16 and tubular member 18 in place when the holder is fully received within the carrier.

Figure 8:
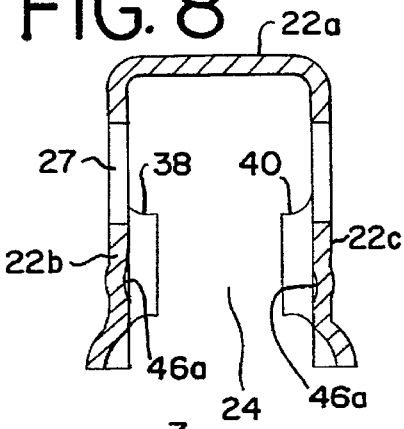
FIG. 8 is a section taken along the line 8—8 of FIG. 6.
Figure 13:
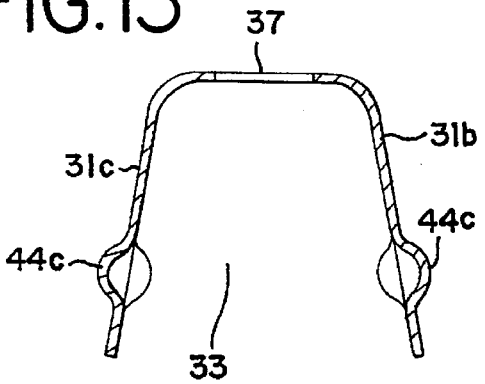
FIG. 13 is a section taken along the line 13—13 of FIG. 11.
Figure 14:
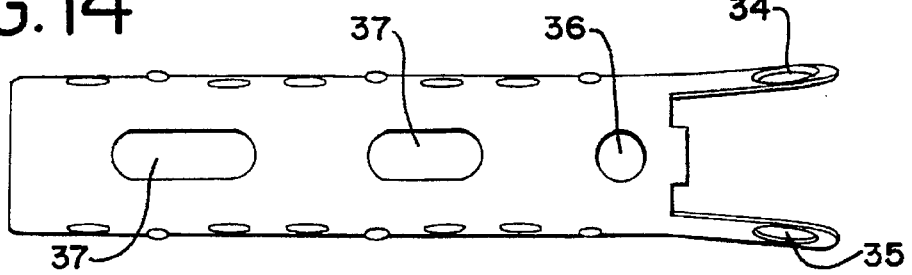
FIG. 14 is a top plan view of the holder.

As noted in FIGS. 11 and 13, the holder 30 includes projections 44*a*–44*c* formed in the side walls 31*b*, 31*c*. Referring to FIGS. 6 and 8, it is seen that the carrier 20 includes dimples or recesses 46*a*–46*c* in the side walls 22*b*, 22*c*. The projections 44*a*–44*c* on the holder 30 are arranged to be snapped into respective recesses 46*a*–46*c* in the carrier 20 for detachably securing the holder in its fully nested position within the carrier as seen in FIG. 3.

Figure 2:
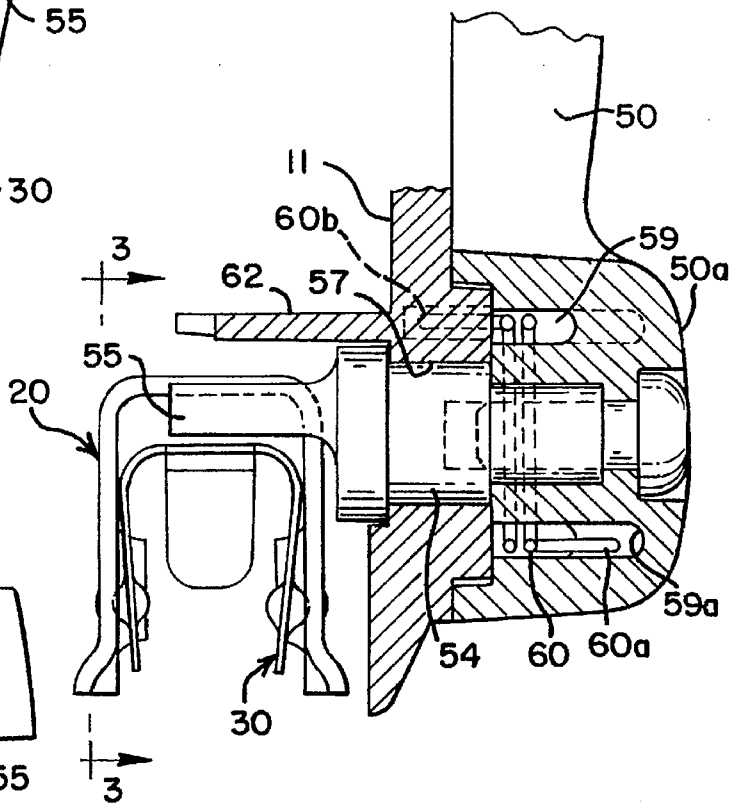
FIG. 2 is a partial front view taken along the line 2—2 of FIG. 1 with most of the tool housing, the tubular sanding member and the contour member removed for better illustration of the clamping mechanism.
Figure 4:
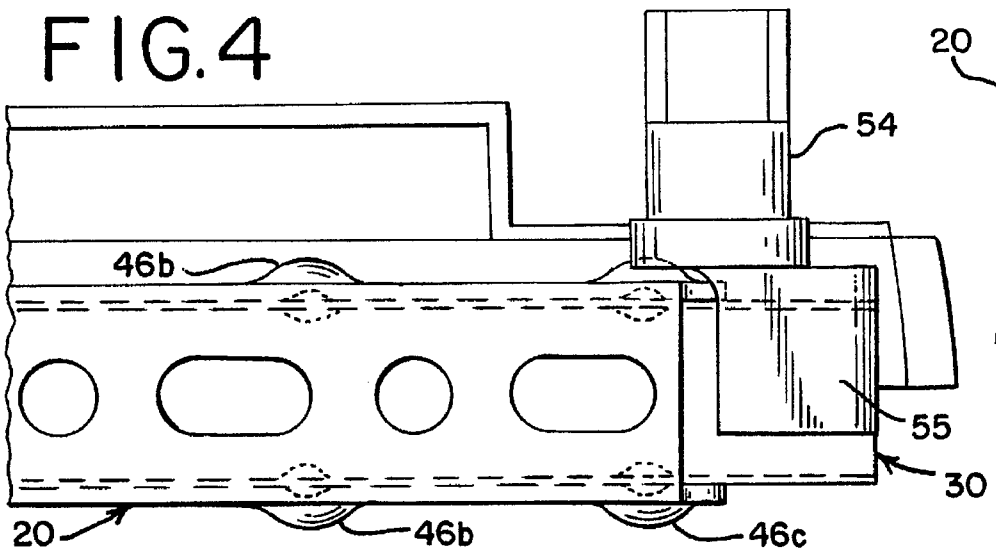
FIG. 4 is a top view taken along the line 4—4 of FIG. 3.

Referring particularly to FIGS. 2–4, an ejection mechanism includes a lever 50 having a hub portion 50*a* with a stepped bore 51. The bore 51 receives the stepped hub 54 forming part of an actuator which includes a bar 55. The hub 54 is rotatably received within an opening 57 formed in the tool housing wall 11. A fastener 58 secures the lever 50 to the hub 54 of the actuator. The hub 50*a* includes an annular opening 59 receiving a coil spring 60. One end 60*a* of the spring is received within a bore 59*a* communicating with the opening 59. The other end 60*b* of the spring is received within a suitable bore formed in the housing 11. It will be understood that the spring 60 urges the lever 50 to rotate in a clockwise direction as seen in FIG. 1.

The lever 50 is held in the position shown in FIG. 1 by engagement of the ejector bar 55 with a wall 62 forming part of the tool housing 11. A recess 64 facilitates engagement of the operator's finger with the lever for rotating the same counterclockwise as seen in FIG. 1.

As noted in FIG. 3, when the holder is in its nested position within the carrier 20, the outer end of the holder 30 projects outwardly from the outer end of the carrier 20. The actuator bar 55 is disposed over this projecting outer end of the holder 30. Thus, when the lever 50 is rotated counterclockwise (FIG. 1), the ejector bar 55 will engage the outer end of the holder 30 thus forcing the same out of the carrier 20 as the holder rotates about the axis 41 (FIG. 7). Separation of the holder from the carrier relieves the squeezing force referred to above thereby permitting ready separation of the contour member 16 and tubular member 18 from the cavity 33 in the holder 30. When it is desired to clamp another contour member 16 and tubular member 18 in place, the portion 16*a* of the contour member and adjacent portion of the tubular member are inserted within the recess 33 of the holder 30. The holder 30 is then manually rotated by the operator whereupon the holder will be snapped into place in the carrier as referred to above. When the holder is fully nested within the carrier, the dimples 42*a*–42*e* will be squeezed or clamped against the tubular portions 18*a* and 18*b* thereby securely holding the tubular member 18 and contour member 16 in place for a powered sanding operation.

It will be seen that the present invention provides a simple but effective mechanism for readily clamping and unclamping a contour member 16 and tubular member 18. The holder, when squeezed within the carrier, is also capable of securely clamping a contour member 16 with tubular members of varying forms as well as a contour member without a tubular member.

The clamping mechanism of the present invention will also accept various accessory sanding devices other than the contour member 16 and tubular sanding member 18. These sanding accessories (not shown) will have a stem portion with a cross-section substantially the same as the cross-section of the contour member portion 16*a* as best seen in FIG. 15. Thus, the term "contour sanding member" as used in the following claims includes the contour members 16 (with or without the tubular member 18) as well as the accessory sanding devices just mentioned.

Although particular preferred embodiments of the invention have been disclosed in detail for illustrative purposes, it will be recognized that variations or modifications of the disclosed apparatus and method lie within the scope of the present invention as defined by the following claims.

We claim:

1. A clamping mechanism for a powered reciprocating sander of the type having a housing mounting a motor connected to a plunger for reciprocating the same along a first axis, said clamping mechanism comprising:

(a) a carrier connected to said plunger for reciprocating therewith, said carrier having a recess open at the bottom thereof;

(b) a holder pivotally mounted to said carrier for swinging movement about a second axis perpendicular to said first axis, said holder being swingable about said second axis back and forth between a first position wherein said holder is substantially nested within the recess in said carrier and a second position wherein a substantial portion of said holder extends out of and away from said recess, said holder being provided with a cavity for receiving a portion of a contour sanding member;

(c) detent means on one of said carrier and said holder for compressing said holder when the latter is in said first position thereby to impart a clamping force to a contour sanding member received within the cavity of said holder; and (d) an ejection means mounted on said housing and adapted for engagement with said holder for moving the same from its first position to its second position.

2. A clamping mechanism for a powered reciprocating sander of the type having a housing mounting a motor connected to a plunger for reciprocating the same along a first axis, said clamping mechanism comprising:

(a) a carrier connected to said plunger for reciprocating therewith, said carrier having a longitudinally extending recess open at the bottom thereof;

(b) a holder pivotally mounted at one end thereof to one end of said carrier for swinging movement about a second axis perpendicular to said first axis, said holder being swingable about said second axis back and forth between a first position wherein said holder is substantially nested within the recess in said carrier and a second position wherein a substantial portion of said holder extends out of and away from said recess, said holder being provided with a longitudinally extending cavity for receiving a portion of a contour sanding member;

(c) detent means on one of said carrier and said holder for compressing said holder when the latter is in said first position thereby to impart a clamping force to a contour sanding member received within the cavity in said holder; and (d) ejection means including an ejection lever pivotally mounted by said housing and connected to an ejector bar, said ejector bar being mounted adjacent the other end of said holder opposite said one end thereof for engaging said other end of the holder thereby to force the holder to swing toward its second position upon rotation of said lever in a first direction.

3. The clamping mechanism according to claim 2 further defined by spring means supported by said housing and connected to said ejector means for urging said ejector lever to rotate in a second direction opposite said first direction.

4. A clamping mechanism for a powered reciprocating sander of the type having a housing mounting a motor connected to a plunger for reciprocating the same along a first axis, said clamping mechanism comprising:

(a) a carrier in the form of an inverted U-shaped bar mounted to said plunger in co-axial relationship therewith, said carrier bar having a bight portion and first and second side walls thereby defining a downwardly facing recess extending longitudinally of the carrier bar, said carrier bar having a first inner end and a second outer end;

(b) a holder in the form of a second inverted U-shaped bar having a bight portion with first and second side walls thereby defining a downwardly facing cavity for receiving a contour sanding member;

(c) pivot means connecting one end of said holder bar to said inner end of said carrier bar for swinging movement about a second axis perpendicular to said first axis, said holder bar being swingable about said second axis back and forth between a first position wherein said holder bar is substantially nested within the recess in said carrier bar and a second position wherein a substantial portion of said holder bar extends out of and away from said recess, said holder bar having a second end opposite said first end and extending beyond the outer end of said carrier bar when said holder bar is in its first position;

(d) detent means mounted on at least one of said side walls for compressing said holder bar when the latter is in said first position thereby to impart a clamping force to a contour sanding member received within the cavity of said holder bar; and (e) ejection means including an ejection lever pivotally mounted by said housing and connected to an ejector bar, said ejector bar being mounted adjacent said second end of said holder bar for engaging said second end of the holder bar to force the holder bar to swing toward its second position upon rotation of said lever in a first direction.

5. The clamping mechanism according to claim 4 further defined by spring means supported by the housing and connected to said ejection means for urging said ejection lever to rotate in a second direction opposite said first direction.

* * * * *